US005214816A

United States Patent [19]

Collins

[11] Patent Number: 5,214,816

[45] Date of Patent: Jun. 1, 1993

[54] TRIANGULAR BODY BOLSTER

[76] Inventor: Robert C. Collins, 3937 Cardinal Dr., Union City, Tenn. 38261

[21] Appl. No.: 942,767

[22] Filed: Sep. 10, 1992

[51] Int. Cl.[5] ..... A47C 20/02

[52] U.S. Cl. ..... 5/656; 5/633; 5/639; 5/643

[58] Field of Search ..... 5/633, 639, 643, 652, 5/656; 297/352

[56] References Cited

U.S. PATENT DOCUMENTS

| | | | |
|---|---|---|---|
| D. 47,140 | 3/1915 | Newkirk . | |
| D. 90,747 | 9/1933 | Barcalo . | |
| D. 279,642 | 7/1985 | Ross . | |
| D. 288,632 | 3/1987 | Grimsrud . | |
| D. 289,481 | 4/1987 | Reddick . | |
| D. 296,403 | 6/1988 | Palm . | |
| 1,890,358 | 12/1932 | Barcalo . | |
| 2,509,537 | 5/1950 | Stier . | |
| 2,736,908 | 3/1956 | Smith | 4/491 |
| 2,856,614 | 10/1958 | O'Leary | 5/633 X |
| 3,003,815 | 10/1961 | Zinn . | |
| 3,555,582 | 1/1971 | Radford | 5/633 X |
| 4,064,580 | 12/1977 | Ezekoye | 5/633 X |
| 4,635,306 | 1/1987 | Willey | 5/633 X |

*Primary Examiner*—Michael F. Trettel
*Attorney, Agent, or Firm*—Richard C. Litman

[57] ABSTRACT

A generally triangular bolster of rigid material provides firm support for persons wishing to recline or lounge upon a surface, while at the same time providing the comfort desired due to its specific structure. The bolster includes three sides which may be equilateral, with each of the sides preferably including an inward or concave curvature. The curvature not only provides additional comfort for the user, but also results in relatively sharp apex edges. The apex edges thus tend to penetrate a compliant surface, such as carpeting, grass, or sand, and thereby prevent the lateral displacement of the bolster when a person reclines upon it. The bolster may be formed of a variety of materials, such as plywood or other wood sheet, or molded or extruded from plastic. Handles near each apex edge provide easier portability, and the bolster may further include internal bracing which also provides storage shelf space within. The exterior sides may be covered with a variety of materials for greater comfort, such as carpeting for indoor use, or with a padded vinyl for outdoor use.

15 Claims, 2 Drawing Sheets

TRIANGULAR BODY BOLSTER

FIELD OF THE INVENTION

The present invention relates generally to home furnishings, and more specifically to a bolster or support for use by persons reclining or lounging on a floor or other surface.

BACKGROUND OF THE INVENTION

Leisure time is important to people, and oftentimes such leisure means nothing more than merely relaxing with a book or a television program, or other restful activity. During such periods, many persons prefer to recline or lounge according to personal preference and the furnishings available; many, particularly younger persons, enjoy at least occasionally lying directly upon the floor, particularly if carpeted or padded in some way.

The act of reclining by definition requires a relatively large amount of space in comparison with the sitting position, and most rooms do not provide the necessary space for a number of standard recliners for several members of a family to enjoy simultaneously. Further, as noted above, some persons at least occasionally prefer a carpeted floor, particularly when relaxing in front of a fireplace, for example. While pillows, cushions and the like are often used for at least some support while reclining, such cushions by their nature generally do not provide the support desired, especially if only a semi-reclining position is desired.

The need arises for a portable bolster which may be moved or stored easily when not in use. The bolster must provide sufficient support for a person reclining thereon without fear of collapse, and should also be formed to accommodate the human body without discomfort. Some form of padding, depending upon the intended environment, is also desired. Other features, such as internal structural bracing which may also serve as shelving for small articles, and handles, may also be provided.

DESCRIPTION OF THE PRIOR ART

U.S. Pat. No. 1,890,358, issued to Edward J. Barcalo on Dec. 6, 1932, discloses a triangular Pillow Or Cushion including a central tie therethrough to prevent excessive deformation. The present invention uses an entirely different structure to achieve a similar objective. The related design patent of the same inventor is discussed further below.

U.S. Pat. No. 2,509,537, issued to Joseph B. Stier on May 30, 1950, discloses a Combined Bag, Seat And Back Rest. The device includes a rigid frame of tubular material which is completely covered by a pliable fabric or sheet material. The structure is accordingly completely unlike that of the present invention.

U.S. Pat. No. 3,003,815, issued to Wilber O. Zinn on Oct. 10, 1961, discloses a Lounging Support of specific exterior shape, and having a soft and resilient core material. The device may easily be deformed, unlike the rigid structure of the present invention.

U.S. Pat. No. D-47,140, issued to Frank Newkirk on Mar. 23, 1915, discloses a design for a Bolster And Sham Holder. The shape is unlike that of the present invention, and no specific structure is disclosed.

U.S. Pat. No. D-90,747, issued to Edward J. Barcalo on Sep. 26, 1933, discloses a Pillow Or Similar Article. This patent is related to the same inventor's utility U.S. Pat. No. 1,890,358 discussed above. The compound convex curvature of the sides is unlike the simple concave curvature of the sides of the present invention.

U.S. Pat. No. D-279 642 issued to Robert M. Ross on Jul. 16, 1985, discloses a Portable Orthopedic Back Rest. The shape of the design bears no resemblance to that of the present invention, nor is any specific structure disclosed.

U.S. Pat. No. D-288,632, issued to Tone Grimsrud on Mar. 10, 1987, discloses a design for a Lounge Seat. The shape is completely unlike that of the present invention, nor is any similar structure disclosed.

U.S. Pat. No. D-289,481, issued to Kenneth T. Reddick on Apr. 28, 1987, discloses a Sacrum Cushion. The design is more closely related to that of the Ross design patent discussed above than to the present invention.

Finally, U.S. Pat. No. D-296,403, issued to David W. Palm on Jun. 28, 1988, discloses a design for an Orthopedic Cushion. The design is more reminiscent of the shape of the Zinn support discussed above, than to the shape or form of the present invention.

None of the above noted patents, taken either singly or in combination, are seen to disclose the specific arrangement of concepts disclosed by the present invention.

SUMMARY OF THE INVENTION

By the present invention, an improved bolster for reclining or lounging is disclosed.

Accordingly, one of the objects of the present invention is to provide a bolster of generally triangular cross section.

Another of the objects of the present invention is to provide a bolster of relatively rigid structure in order to provide the required support for a semi-reclining person.

Yet another of the objects of the present invention is to provide a bolster which is formed of relatively thin but rigid sheet material, and includes internal structural bracing which bracing is further useful as shelving for small articles.

Still another of the objects of the present invention is to provide a bolster which may be formed of a variety of materials and a variety of methods, including wood and/or plywood, or plastic material using injection molding, extrusion or other manufacturing techniques.

A further object of the present invention is to provide a bolster which may include padding, such as carpeting or padded vinyl material, thereon.

An additional object of the present invention is to provide a bolster which is light weight and easily portable, and includes handles for easy carriage.

Another object of the present invention is to provide a triangular bolster which has three equilateral sides which are formed to comfortably accommodate the human form.

Still another object of the present invention is to provide a bolster having a precisely formed simple or two dimensional concave curvature in each of the sides.

Yet another object of the present invention is to provide a bolster which includes relatively sharply angled apex edges at the juncture of each of the faces, the sharply angled apex edges providing some penetration into an underlying compliant or resilient surface by a lower apex edge in order to prevent lateral movement of the bolster.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
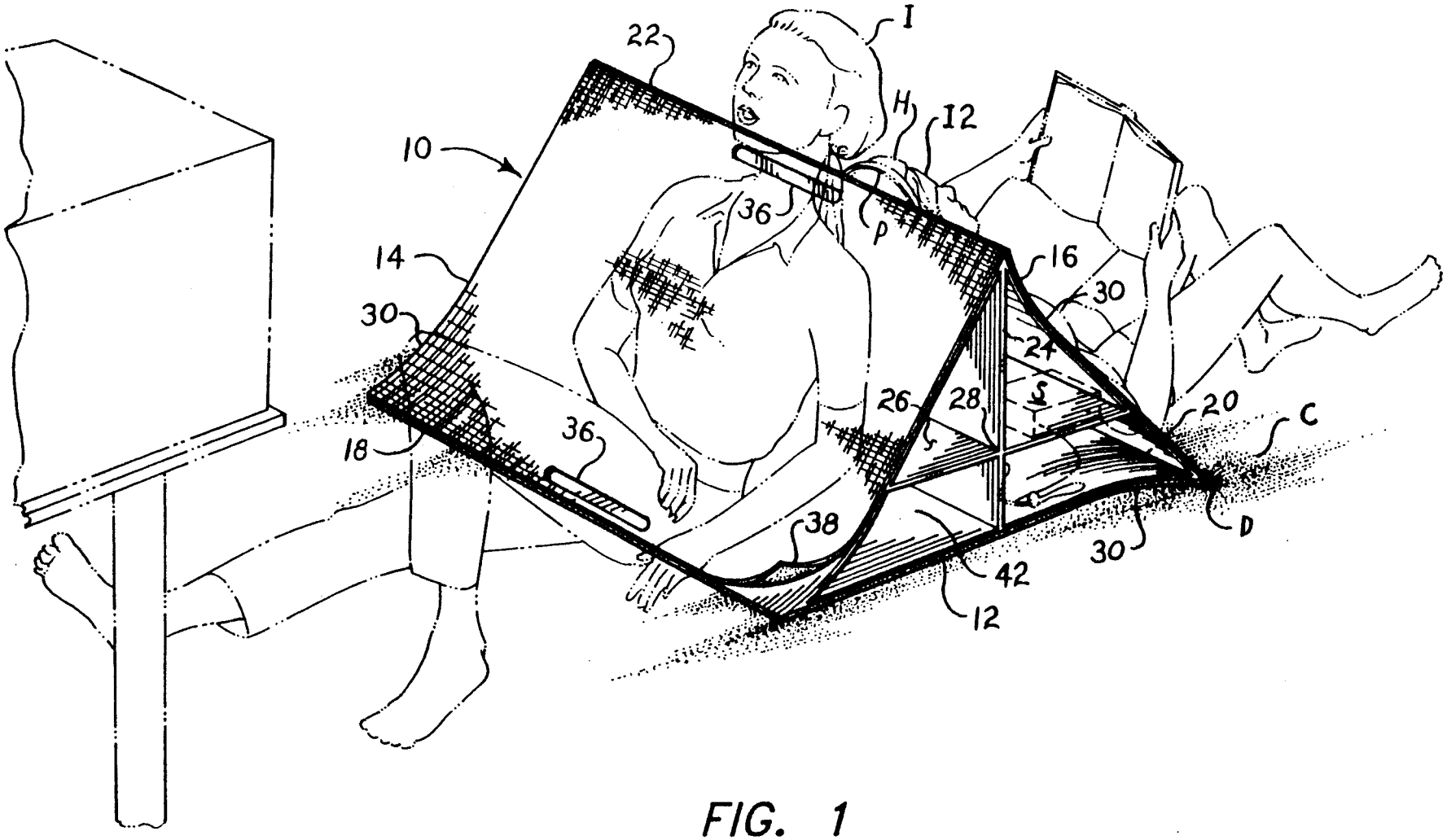
FIG. 1 is an environmental perspective view of the bolster of the present invention, showing its various features and use.

Referring now to the drawings, and particularly FIG. 1 of the drawings, the present invention will be seen to relate to a bolster 10 of generally triangular configuration which is useful for individuals wishing to recline or lounge upon a floor or other suitable surface. Bolster 10 will be seen to be formed of three sides 12, 14 and 16, joined along parallel apex edges 18, 20 and 22. First apex edge 18 serves to join first or base side 12 and second or primary support side 14, while second apex edge 20 joins first or base side 12 and third or secondary support side 16, and third apex edge 22 joins the second or primary support side 14 and the third or secondary support side 16. A first or vertical bracing plate 24 extends from the inside of third apex edge 22 to generally bisect the interior angle formed by the two support sides 14 and 16, while a second or horizontal bracing plate 26 extends between the interior surfaces of the two support sides 14 and 16 to perpendicularly intersect the first vertical bracing plate 24. Preferably, second bracing plate 26 is positioned across sides 14 and 16 to intersect the first bracing plate 24 approximately one third of the distance upward from base side 12 to the opposite third apex edge 22. Thus, the intersection 28 formed by first and second bracing plates 24 and 26 will be seen to be at the approximate geometric center of the generally triangular shape formed by sides 12, 14 and 16.

Figure 2:
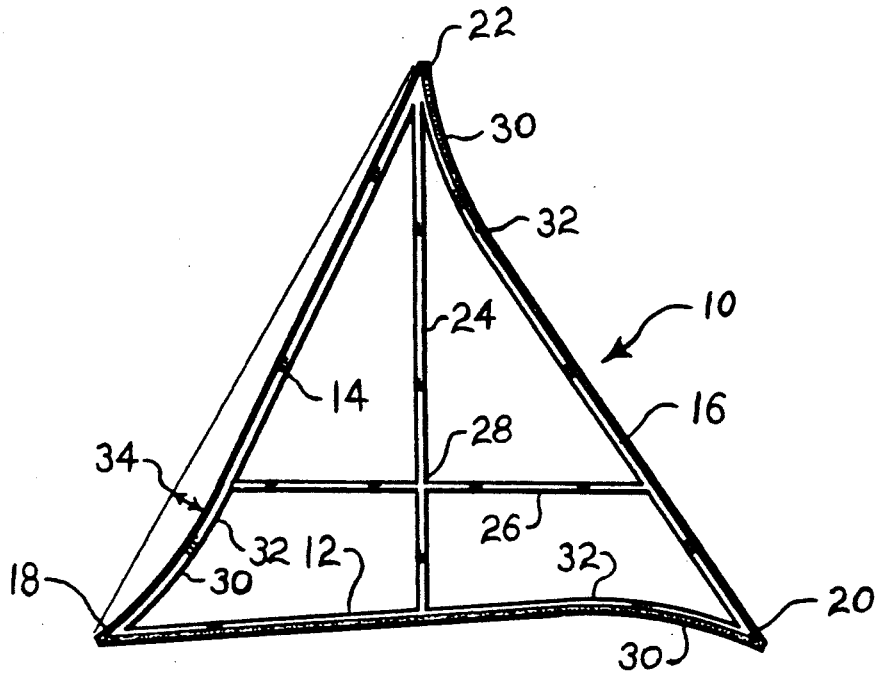
FIG. 2 is an end elevational view of the bolster, showing the internal structure.

Each side 12, 14 and 16 of bolster 10 will be seen to have an inward or concave curve or depression 30 beginning at the approximate quarter chord location 32, more clearly shown in FIG. 2. These concave curvatures 30 are simple curves in two dimensions, as opposed to compound, three dimensional curves. Thus, bolster 10 may be formed of readily available sheet materials if desired, rather than absolutely requiring special molds. Preferably, these concave curvatures have a camber or depth 34 of approximately one sixteenth the length of each side 12, 14 and 16 as measured between apex edges 18, 20 and 22, or approximately 6.25 percent as shown with side 14 of FIG. 2. These concave curvatures 30 will be seen to result in relatively sharp apex edges 18, 20 and 22, having an included angle somewhat less than the standard 60 degrees normally achieved in such equilateral triangular structures; the apex included angle achieved by means of the present invention more closely approximates some 35 to 40 degrees. This sharper angle provides some benefits in the use of bolster 10, as will be more fully explained further below.

As noted above, bolster 10 may be constructed from readily available sheet materials, such as wood or plywood suitably bent to form the curves 30 required in each side 12, 14 and 16. However, such construction is relatively labor intensive and is therefore not desirable for quantity production. Preferably, bolster 10 is formed of a molded or extruded plastic material, which technology lends itself to the rapid production of such shapes. While suitable molds may be easily constructed for the molding or casting of bolsters 10, the linear, open shape of bolster 10 further lends itself to production by means of an extrusion die, where continuous lengths of the shape described above and disclosed in the drawing figures may be extruded and cut to any desired length. The hand hold slots 36 or **36*a* respectively shown in FIGS. 1 and 3 may be cast at the time such a bolster 10** is molded, or may be later punched or otherwise formed in an extrusion.

Preferably, some form of padding or cushioning is desirable on the outer surfaces or sides 12, 14 and 16 of bolster 10, as bolster 10 is formed of relatively firm and unforgiving materials as discussed above. Such padding or cushioning may take any number of forms, depending upon the intended use of bolster 10. In the environment shown in FIG. 1, where bolster 10 is to be used primarily in an interior environment such as a carpeted living room, bolster 10 may be covered with carpeting 38 as shown. Such carpeting 38 may be chosen to match or complement the carpeting C already in place, or alternatively may be chosen to provide a contrasting color and texture as desired.

Figure 3:
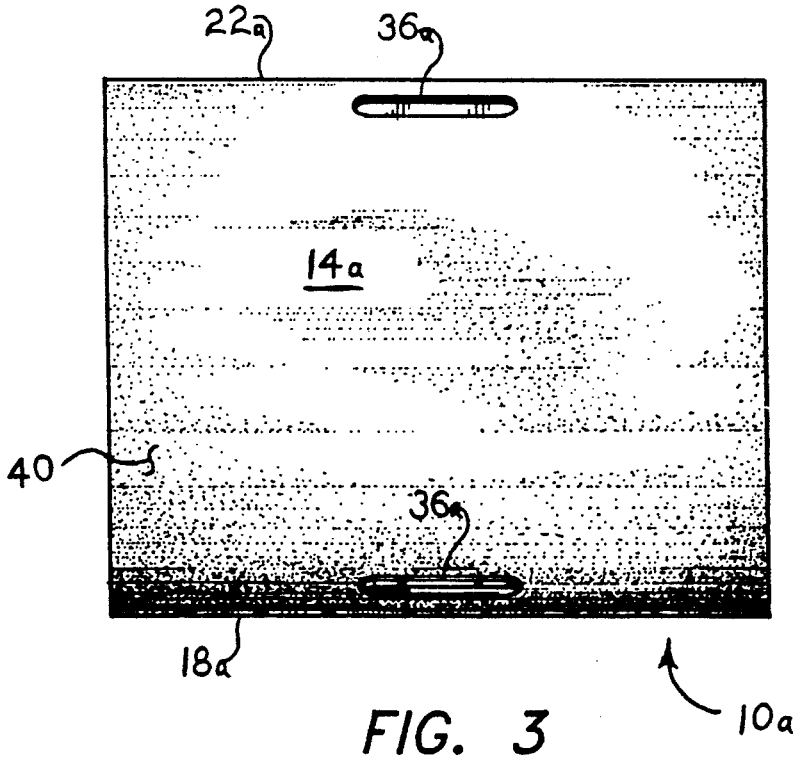
FIG. 3 is a side view of one of the faces of the bolster, showing an alternative covering material and other features.

While such a carpeted covering 38 may be desirable in an interior environment, the lack of water resistance and tendency to entrap dirt and sand particles and the like render such a covering material 38 less desirable for outdoor use. Some persons may wish to make use of a bolster 10 in the back yard or at the beach, etc. In such environments, it is desirable that any covering material provided be (1) water resistant, and (2) easily cleanable. Accordingly, a bolster **10*a* of FIG. 3 shows a different covering material 40, representing a padded sheet vinyl or the like. Obviously, other materials may be used as desired, such as other types of upholstered fabrics, etc. The remaining component callous 14*a*, 18*a*, 22*a*, and 36*a* of bolster 10*a* shown in FIG. 3 will be seen to correspond directly with like components shown in FIGS. 1 and 2, as appropriate. The only difference between the bolster 10 of FIGS. 1 and 2 and bolster 10*a* of FIG. 3, is in the respective covering material 38 or 40** applied thereto.

When use is desired to be made of bolster 10, it may be taken from storage and placed as desired in the environment shown in FIG. 1 or other area, as desired. Preferably, an individual I desiring to use bolster 10 will place the first or base side 12 downward at the desired location, generally resting upon the carpeting C or other surface. The individual may then recline against the second or primary support side 14, with the concave curvature 30 of that side 14 forming a complementary and comfortable support for the lower hips and back when individual I establishes a semi-reclining posture.

A problem which frequently occurs when a support having a planar bottom surface is placed upon an underlying surface, is that the relatively low friction between the overlying support bottom surface and the underlying surface allows the support to be slid or laterally displaced due to the force of the person reclining against the support. The specific shape of bolster 10 responds to this problem by means of the relatively sharp angle of each apex edge 18, 20 and 22, provided by the concave curvature 30 at the quarter chord line 32 of each side 12, 14 and 16. These relatively sharp apex edges, e.g., edge 20 of FIG. 1, will tend to at least slightly penetrate or "dig into" any compliant or resilient underlying surface, such as the depression D formed in carpeting C shown, and thus prevent any unilateral force from a single individual I from causing lateral displacement of bolster 10. The same principle applies when a bolster 10 or 10*a* is used upon any somewhat compliant or resilient surface, such as a lawn, beach, or other surface.

While bolsters 10 and 10*a* provide adequate and relatively nondisplaceable support for a single reclining person, the essentially equilateral shape further permits a second individual I2 to simultaneously recline upon the opposite or secondary support surface 16 as shown in FIG. 1. As the concave curvature 30 of secondary support surface 16 lies near the third or upper apex edge 22, as bolster 10 is shown in FIG. 1, an individual I2 reclining upon the secondary support side 16 may wish to take on a more supine position, in order to allow the head H of individual I2 to rest more comfortably within the curvature 30 of secondary support side 16. Further, while a bolster 10 or 10*a* may be oriented with any side 12, 14 or 16 downward to the same effect, the orientation described above provides for a horizontal second brace plate 26, which plate 26 may then be used as shelving for the storage of various articles such as a personal sound system S, headphones P when not in use, snacks, etc. The open space 42 within bolster 10 as defined by sides 12, 14 and 16 when formed of sheet material as shown, provides sufficient storage space for a multitude of articles limited only by the imagination of the user.

Obviously, any individuals using a bolster 10 or 10*a* may seek out whatever position is most comfortable, and the above description should not be seen to limit the function of a bolster 10 or 10*a*. Further, it should again be emphasized that the nature of the relatively sharp angles of the apex edges 18, 20 and 22 allows them to at least slightly penetrate any somewhat compliant or resilient surface and thereby preclude the sliding or lateral displacement of a bolster 10 or 10*a*, even though only a single individual I may be reclining thereupon and imparting an unbalanced unilateral force. The second individual I2 shown in FIG. 1 is merely to further demonstrate the versatility of bolster 10, and it is not at all necessary to have two individuals I and I2 reclining upon opposite faces of a bolster 10 in order for lateral movement to be prevented.

Obviously, other uses for bolster 10 may be readily envisioned, such as while sitting up in bed for reading, TV, etc., or upon another article of furniture such as a couch or the like. The hand hold slots 36 and 36*a* respectively of bolsters 10 and 10*a* provide for the ready placement or removal of a bolster 10 or 10*a* to or from virtually any location desired. As noted above, the precise orientation of a bolster 10 or 10*a* is unimportant due to the preferably equilateral nature of the device, but the orientation shown throughout the drawings and discussed in the specification provides the additional advantage of having second brace plate 26 oriented horizontally, thus providing further versatility as a shelf.

It is to be understood that the present invention is not limited to the sole embodiment described above, but encompasses any and all embodiments within the scope of the following claims.

I claim:

1. A triangular bolster for use by persons for reclining thereupon, said bolster comprising:

three side surfaces each having two opposed edges with each of said two opposed edges of one of said side surfaces joined with one of said two opposed edges from another of said side surfaces to form three apex edges;

said three side surfaces and said three apex edges thereby defining a prismatic shell of triangular cross section for said bolster;

said three side surfaces formed of rigid, generally planar sheet material, with said prismatic shell of triangular cross section including an open space therein; and handle means adjacent each of said apex edges.

2. The bolster of claim 1 wherein:

said triangular cross section is substantially equilateral.

3. The bolster of claim 1 wherein:

said side surfaces each include an inwardly curved portion so that the included angles formed at said apex edges are each less than 60 degrees, whereby when one of said side surfaces is placed upon a compliant surface, a normal force is applied to another of said side surfaces, and one of said apex edges of said one of said side surfaces placed upon the compliant surface engages the compliant surface, sliding of said bolster upon the compliant surface is prevented.

4. The bolster of claim 3 wherein:

said inwardly curved portions of said side surfaces have a maximum depth of inward curving located about one quarter of the distance across each of said side surfaces between said two opposed edges.

5. The bolster of claim 3 wherein:

said inwardly curved portions of said side surfaces have a maximum depth of inward curving of about one sixteenth of the distance across each of said side surfaces between said two opposed edges.

6. The bolster of claim 1 further comprising:

internal bracing within said open space within said prismatic shell of said triangular cross section of said bolster.

7. The bolster of claim 6 wherein:

said internal bracing comprises a first bracing plate affixed medially to a first side surface of said bolster and extending to an opposite apex edge, and a second bracing plate extending between second and third side surfaces of said bolster and forming a joint with said first bracing plate at an angle normal thereto, whereby said second bracing plate provides a shelf when said bolster is positioned with said first side of said bolster resting upon a generally horizontal surface and said second bracing plate is in a generally horizontal plane.

8. The bolster of claim 7 wherein:

said joint between said second bracing plate with said first bracing plate is located at, approximately, the center of said triangular cross section.

9. The bolster of claim 1 wherein:

said handle means comprise elongate slots in each of said side surfaces with said elongate slots parallel to said apex edges.

10. The bolster of claim 1 wherein:

said bolster is formed of wood.

11. The bolster of claim 10 wherein:

said wood is plywood.

12. The bolster of claim 1 wherein:

said bolster is formed of a plastic material.

13. The bolster of claim 12 wherein:

said plastic material is extruded.

14. A triangular bolster for use by persons for reclining thereupon, said bolster comprising:

three side surfaces each having two opposed edges with each of said two opposed edges of one sad side surfaces joined with one of said two opposed edges from another of said side surfaces to form three apex edges;

said three side surfaces and said three apex edges thereby defining a prismatic shell of triangular cross section for said bolster;

said three side surfaces formed of rigid generally planar sheet material, with said prismatic shell of triangular cross section including an open space therein; and said bolster including an overlay of a padded material comprising carpeting.

15. A triangular bolster for sue by persons for reclining thereupon, said bolster comprising:

three side surfaces each having two opposed edges with each of said two opposed edges of one of said side surfaces joined with one of said two opposed edges form another of said side surfaces to form three apex edges;

said three side surfaces and said three apex edges thereby defining a prismatic shell of triangular cross section for said bolster;

said three side surfaces formed of rigid, generally planar sheet material, with said prismatic shell of triangular cross section including an open space therein; and said bolster including an overlay of a padded material comprising a vinyl composition.

* * * * *